US007322415B2

(12) United States Patent
de St. Remey

(10) Patent No.: US 7,322,415 B2
(45) Date of Patent: Jan. 29, 2008

(54) SUBTERRANEAN ELECTRO-THERMAL HEATING SYSTEM AND METHOD

(75) Inventor: Edward Everett de St. Remey, Anchorage, AK (US)

(73) Assignee: Tyco Thermal Controls LLC, Redwood City, CA (US)

( * ) Notice: Subject to any disclaimer, the term of this patent is extended or adjusted under 35 U.S.C. 154(b) by 426 days.

(21) Appl. No.: 10/909,233

(22) Filed: Jul. 29, 2004

(65) Prior Publication Data

US 2006/0021752 A1 Feb. 2, 2006

(51) Int. Cl.
*E21B 36/02* (2006.01)

(52) U.S. Cl. ..... 166/302; 166/61; 166/901

(58) Field of Classification Search ..... 166/302, 166/57, 60, 61, 901
See application file for complete search history.

(56) References Cited

U.S. PATENT DOCUMENTS

| | | | | |
|---|---|---|---|---|
| 3,214,571 | A * | 10/1965 | Indoe | 219/544 |
| 3,861,029 | A | 1/1975 | Smith-Johannsen et al. | 29/611 |
| 3,949,189 | A | 4/1976 | Bilbro et al. | 219/301 |
| RE29,332 | E | 8/1977 | Bilbro et al. | 165/164 |
| 4,068,966 | A | 1/1978 | Johnson et al. | 403/397 |
| 4,123,837 | A | 11/1978 | Horner | 29/157 |
| 4,152,577 | A | 5/1979 | Leavines | 219/301 |
| 4,214,147 | A * | 7/1980 | Kraver | 392/468 |
| 4,284,841 | A | 8/1981 | Tijunelis et al. | 174/103 |
| 4,303,826 | A | 12/1981 | Ando | 219/301 |
| 4,490,577 | A | 12/1984 | Neuroth | 174/103 |
| 4,538,682 | A | 9/1985 | McManus et al. | 166/255 |
| 4,572,299 | A | 2/1986 | Vanegmond et al. | 166/385 |
| 4,694,907 | A | 9/1987 | Stahl et al. | 166/303 |
| 4,707,568 | A | 11/1987 | Hoffman et al. | 174/103 |
| 5,070,533 | A * | 12/1991 | Bridges et al. | 392/301 |
| 5,086,836 | A | 2/1992 | Barth et al. | 165/164 |
| 5,105,880 | A | 4/1992 | Shen | 166/249 |
| 5,394,507 | A | 2/1995 | Okamoto | 392/480 |
| 5,539,853 | A | 7/1996 | Jamaluddin et al. | 392/302 |
| 5,714,106 | A | 2/1998 | Yoda et al. | 264/275 |
| 5,782,301 | A | 7/1998 | Neuroth et al. | 166/302 |
| 6,410,893 | B1 * | 6/2002 | Yagnik et al. | 219/540 |

* cited by examiner

*Primary Examiner*—William Neuder
(74) *Attorney, Agent, or Firm*—Wyatt B. Pratt; Tyco Thermal Controls, LLC

(57) ABSTRACT

A subterranean electro-thermal heating system including one or more heater cable sections extending through one or more heat target regions of a subterranean environment and one or more cold lead sections coupled to the heater cable section(s) and extending through one or more non-target regions of the subterranean environment. A cold lead section delivers electrical power to a heater cable section but generates less heat than the heater cable section. The heater cable section(s) and the cold lead section(s) are arranged to deliver thermal input to one or more localized areas in the subterranean environment.

47 Claims, 5 Drawing Sheets

SUBTERRANEAN ELECTRO-THERMAL HEATING SYSTEM AND METHOD

TECHNICAL FIELD

The present invention relates to subterranean heating and more particularly, to a subterranean electro-thermal heating system and method.

BACKGROUND

Heating systems may be used in subterranean environments for various purposes. In one application, a subterranean heating system may be used to facilitate oil production. Oil production rates have decreased in many of the world's oil reserves due to difficulties in extracting the heavy oil that remains in the formation. Various production-limiting issues may be confronted when oil is extracted from heavy oil field reservoirs. For example, the high viscosity of the oil may cause low-flow conditions. In oil containing high-paraffin, paraffin may precipitate out and form deposits on the production tube walls, thereby choking the flow as the oil is pumped. In high gas-cut oil wells, gas expansion may occur as the oil is brought to the surface, causing hydrate formation, which significantly lowers the oil temperature and thus the flow.

Heating the oil is one way to address these common production-limiting issues and to promote enhanced oil recovery (EOR). Both steam and electrical heaters have been used as a source of heat to promote EOR. One technique, referred to as heat tracing, includes the use of mechanical and/or electrical components placed on piping systems to maintain the system at a predetermined temperature. Steam may be circulated through tubes, or electrical components may be placed on the pipes to heat the oil.

These techniques have some drawbacks. Steam injection systems may be encumbered by inefficient energy use, maintenance problems, environmental constraints, and an inability to provide accurate and repeatable temperature control. Although electrical heating is generally considered to be advantageous over steam injection heating, electrical heating systems typically cause unnecessary heating in regions that do not require heating to facilitate oil flow. The unnecessary heating is associated with inefficient power usage and may also cause environmental issues such as undesirable thawing of permafrost in arctic locations.

Accordingly, there is a need for a subterranean electro-thermal heating system that is capable of efficiently and reliably delivering thermal input to localized areas in a subterranean environment.

BRIEF DESCRIPTION OF THE DRAWINGS

Advantages of the present invention will be apparent from the following detailed description of exemplary embodiments thereof, which description should be considered in conjunction with the accompanying figures of the drawing, in which.

DETAILED DESCRIPTION

In general, a subterranean electro-thermal heating system consistent with the invention may be used to deliver thermal input to one or more localized areas in a subterranean environment. Applications for a subterranean electro-thermal heating system consistent with the invention include, but are not limited to, oil reservoir thermal input for enhanced oil recovery (EOR), ground water or soil remediation processes, in situ steam generation for purposes of EOR or remediation, and in situ hydrocarbon cracking in localized areas to promote lowering of viscosity of oil or oil-laden deposits. Exemplary embodiments of a subterranean electro-thermal heating system are described in the context of oil production and EOR. It is to be understood, however, that the exemplary embodiments are described by way of explanation, and are not intended to be limiting.

Figures 1, 2, 3, 4:
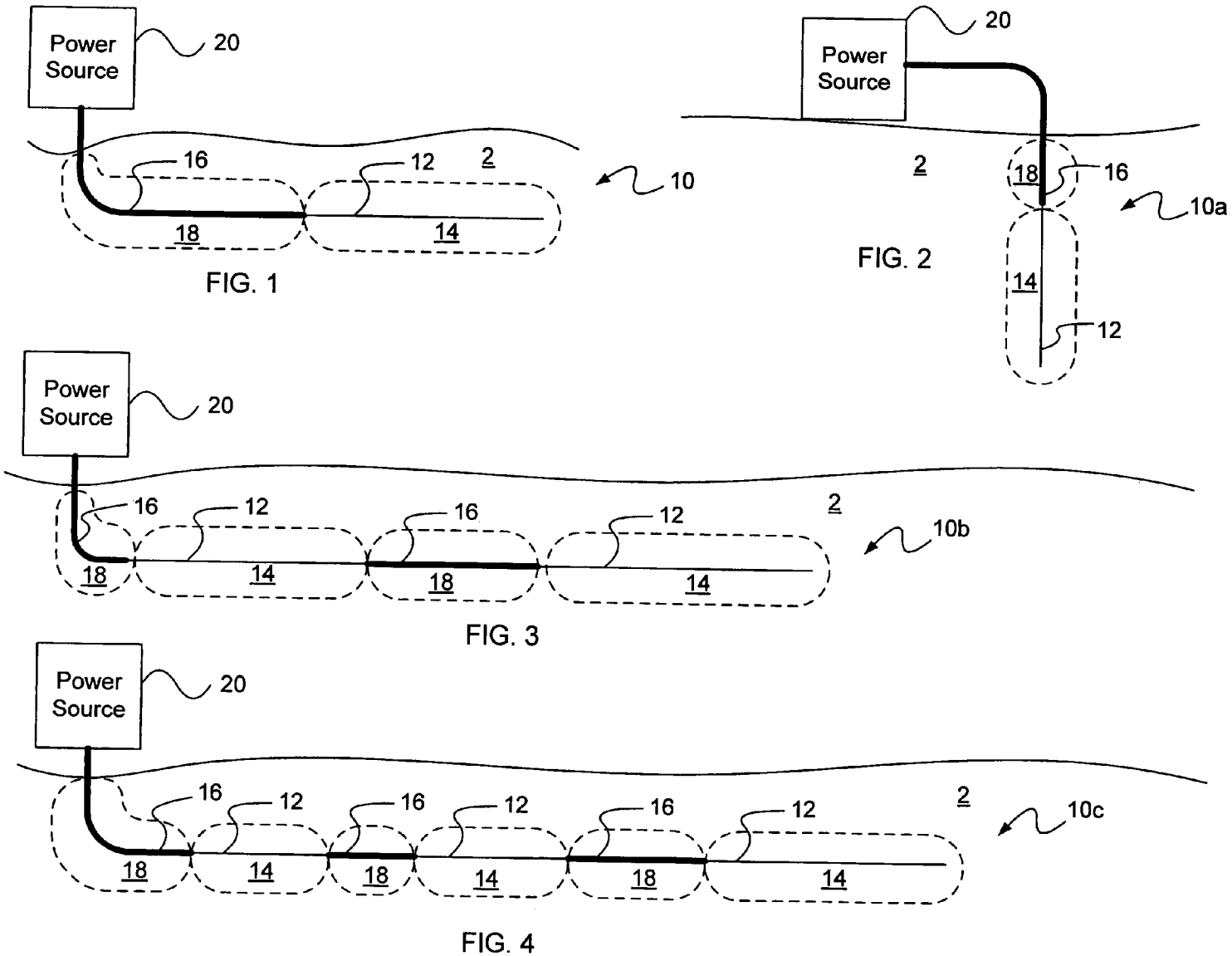
FIGS. 1-4 are schematic diagrams of different embodiments of a subterranean electro-thermal heating system consistent with the present invention including various arrangements of heater cable sections and cold lead sections.

FIG. 1 illustrates one exemplary embodiment 10 of a subterranean electro-thermal heating system consistent with the present invention. The illustrated exemplary system 10 includes a power source 20 electrically coupled to a heater cable section 12 through a cold lead cable section 16. The cold lead cable section 16 is disposed in a non-target region 18 of a subterranean environment 2, and the heater cable section 12 is disposed in a heat target region 14 of the subterranean environment 2. The heat target region 14 may be any region in the subterranean environment 2 where heat is desired, e.g. to facilitate oil flow. The non-target region 18 may be any region in the subterranean environment 2 where heat is not desired and thus is minimized, for example, to conserve power or to avoid application of significant heat to temperature sensitive areas such as permafrost in an arctic subterranean environment.

The length, configuration and number of the heater cable sections and the cold lead cable sections may vary depending on the application. In EOR applications, the exemplary cold lead section 16 may be at least about 700 meters in length and may extend up to about 1000 meters in length.

Also, the heat generated in the cold lead section and heater cable sections may be directly related to the power consumption of these sections. In one embodiment, it is advantageous that the power consumed in the cold lead section(s) 16 be less than about 10% of the power consumed in the heater cable section(s) 12. In an EOR application, for example, power consumption in the heater cable section 12 may be about 100 watts/ft. and power consumption in the cold lead section 12 may be less than about 10 watts/ft. In another embodiment, the cold lead section(s) may be configured such that the voltage drop across the sections is less than or equal to 15% of the total voltage drop across all cold lead and heater cable sections in the system.

Those of ordinary skill in the art will recognize that power consumption and voltage drop in the cold lead sections may vary depending on the electrical characteristics of the particular system. Table 1 below illustrates the power consumption and line voltage drop for cold leads of various conductor sizes and lengths of 700, 800, 900, and 1000 meters in a system wherein the power source is a 480V single phase source and in a system wherein the power source is a 480V three phase source. Table 2 below illustrates the power consumption and line voltage drop for cold leads of various conductor sizes and lengths of 700, 800, 900, and 1000 meters in a system wherein the power source is a 600V single phase source and in a system wherein the power source is a 600V three phase source. For the exemplary configurations described in Tables 1 and 2, the cold lead conductor was sized to not exceed a 15% voltage drop or 10 watts/ft of well, and the conductor temperature was set at an average of 75° C.

TABLE 1

| | | 480 Volts 1 Phase | | | 480 Volts 3 Phase | | |
|---|---|---|---|---|---|---|---|
| 15 KW Current/Cond. => | | 31.3 Amps | | | 18.0 Amps | | |
| Lead Length | | Cond. | Volts Drop | W/Ft. of | Cond. | Volts Drop | W/Ft. of |
| Meters | Feet | Size | % | Well | Size | % | Well |
| 700 | 2297 | 6 | 14 | 1.0 | 8 | 12 | 0.8 |
| 800 | 2625 | 4 | 11 | 0.6 | 8 | 14 | 0.8 |
| 900 | 2953 | 4 | 12 | 0.6 | 8 | 15 | 0.8 |
| 1000 | 3281 | 4 | 14 | 0.6 | 6 | 11 | 0.5 |
| 25 KW Current/Cond. => | | 52.1 Amps | | | 30.1 Amps | | |
| Lead Length | | Cond. | Volts Drop | W/Ft. of | Cond. | Volts Drop | W/Ft. of |
| Meters | Feet | Size | % | Well | Size | % | Well |
| 700 | 2297 | 3 | 12 | 1.3 | 6 | 13 | 1.3 |
| 800 | 2625 | 3 | 14 | 1.3 | 6 | 14 | 1.3 |
| 900 | 2953 | 2 | 13 | 1.1 | 4 | 10 | 0.9 |
| 1000 | 3281 | 2 | 14 | 1.1 | 4 | 12 | 0.9 |
| 50 KW Current/Cond. => | | 104.2 Amps | | | 60.1 Amps | | |
| Lead Length | | Cond. | Volts Drop | W/Ft. of | Cond. | Volts Drop | W/Ft. of |
| Meters | Feet | Size | % | Well | Size | % | Well |
| 700 | 2297 | 1/0 | 12 | 2.7 | 3 | 12 | 2.7 |
| 800 | 2625 | 1/0 | 14 | 2.7 | 3 | 14 | 2.7 |
| 900 | 2953 | 2/0 | 13 | 2.1 | 2 | 13 | 2.1 |
| 1000 | 3281 | 2/0 | 14 | 2.1 | 2 | 14 | 2.1 |

TABLE 2

| | | 600 Volts 1 Phase | | | 600 Volts 3 Phase | | |
|---|---|---|---|---|---|---|---|
| 15 KW Current/Cond. => | | 25.0 Amps | | | 14.4 Amps | | |
| Lead Length | | Cond. | Volts Drop | W/Ft. of | Cond. | Volts Drop | W/Ft. of |
| Meters | Feet | Size | % | Well | Size | % | Well |
| 700 | 2297 | 8 | 15 | 1 | 10 | 12 | 0.8 |
| 800 | 2625 | 6 | 11 | 0.6 | 10 | 14 | 0.8 |
| 900 | 2953 | 6 | 12 | 0.6 | 8 | 10 | 0.5 |
| 1000 | 3281 | 6 | 14 | 0.6 | 8 | 11 | 0.5 |
| 25 KW Current/Cond. => | | 41.7 Amps | | | 24.1 Amps | | |
| Lead Length | | Cond. | Volts Drop | W/Ft. of | Cond. | Volts Drop | W/Ft. of |
| Meters | Feet | Size | % | Well | Size | % | Well |
| 700 | 2297 | 4 | 10 | 1.1 | 8 | 13 | 1.4 |
| 800 | 2625 | 4 | 12 | 1.1 | 8 | 15 | 1.4 |
| 900 | 2953 | 4 | 13 | 1.1 | 6 | 10 | 0.9 |
| 1000 | 3281 | 4 | 15 | 1.1 | 6 | 11 | 0.9 |
| 50 KW Current/Cond. => | | 83.3 Amps | | | 48.1 Amps | | |
| Lead Length | | Cond. | Volts Drop | W/Ft. of | Cond. | Volts Drop | W/Ft. of |
| Meters | Feet | Size | % | Well | Size | % | Well |
| 700 | 2297 | 2 | 13 | 2.7 | 4 | 10 | 2.2 |
| 800 | 2625 | 2 | 14 | 2.7 | 4 | 12 | 2.2 |
| 900 | 2953 | 1 | 13 | 2.2 | 4 | 13 | 2.2 |
| 1000 | 3281 | 1 | 14 | 2.2 | 4 | 15 | 2.2 |

One or more cold lead and heater cable sections consistent with the present invention may be provided in a variety of configurations depending on system requirements. FIG. 2, for example, illustrates another exemplary embodiment 10*a* of a subterranean electro-thermal heating system consistent with the invention. In the illustrated embodiment, a heater cable section 12 and cold lead section 16 have a generally vertical orientation in the subterranean environment 2. The cold lead section 16 extends through a non-target region 18 of a subterranean environment 2 to electrically connect the heater cable section 12 in the heat target region 14 to the power source 20. Those of ordinary skill in the art will recognize that a system consistent with the invention is not limited to any particular orientation, but can be implemented in horizontal, vertical, or other orientations or combinations of orientations within the subterranean environment 12. The orientation for a given system may depend on the requirements of the system and/or the orientation of the regions to be heated.

A system consistent with the invention may also be implemented in a segmented configuration, as shown, for example, in FIGS. 3 and 4. FIG. 3 illustrates a segmented subterranean electro-thermal heating system 10*b* including an arrangement of multiple heater cable sections 12 and cold lead sections 16. The heater cable sections 12 and the cold lead sections 16 are configured, interconnected and positioned based on a predefined pattern of heat target regions 14 and non-target regions 18 in the subterranean environment 2.

Thus, the heater cable sections 12 and the cold lead sections 16 may be strategically located to focus the electro-thermal energy to multiple desired areas in the subterranean environment 2, while regulating the heat input and avoiding unnecessary heating. FIG. 4 shows another exemplary embodiment 10*c* of a system consistent with the invention wherein the heater cable sections 12 and cold lead sections 16 have various lengths depending upon the size of the corresponding heat target regions 14 and non-target regions 18. Although the exemplary embodiments show specific patterns, configurations, and orientations, the heater cable sections and cold lead sections can be arranged in other patterns, configurations and orientations.

The heater cable sections 12 may include any type of heater cable that converts electrical energy into heat. Such heater cables are generally known to those skilled in the art and can include, but are not limited to, standard three phase constant wattage cables, mineral insulated (MI) cables, and skin-effect tracing systems (STS).

One example of a MI cable includes three (3) equally spaced nichrome power conductors that are connected to a voltage source at a power end and electrically joined at a termination end, creating a constant current heating cable. The MI cable may also include an outer jacket made of a corrosion-resistant alloy such as the type available under the name Inconel.

In one example of a STS heating system, heat is generated on the inner surface of a ferromagnetic heat tube that is thermally coupled to a structure to be heated (e.g., to a pipe carrying oil). An electrically insulated, temperature-resistant conductor is installed inside the heat tube and connected to the tube at the far end. The tube and conductor are connected to an AC voltage source in a series connection. The return path of the circuit current is pulled to the inner surface of the heat tube by both the skin effect and the proximity effect between the heat tube and the conductor.

In one embodiment, the cold lead section 16 may be a cable configured to be electrically connected to the heater cable section 12 and to provide the electrical energy to the heater cable section 12 while generating less heat than the heater cable section 16. The design of the cold lead section 16 may depend upon the type of heater cable and the manner in which heat is generated using the heater cable. When the heater cable section 12 includes a conductor or bus wire and uses resistance to generate heat, for example, the cold lead section 16 may be configured with a conductor or bus wire with a lower the resistance (e.g., a larger cross-section). The lower resistance allows the cold lead section 16 to conduct electricity to the heater cable section 12 while minimizing or preventing generation of heat. When the heater cable section 12 is a STS heating system, the cold lead section 16 may be configured with a different material for the heat tube and with a different attachment between the tube and the conductor to minimize or prevent generation of heat.

In an EOR application, a subterranean electro-thermal heating system consistent with the present invention may be used to provide either downhole heating or bottom hole heating. The system may be secured to a structure containing oil, such as a production tube or an oil reservoir, to heat the oil in the structure. In these applications, at least one cold lead section 16 may be of appropriate length to pass through the soil to the location where the oil is to be heated, for example, to the desired location on the production tube or to the upper surface of the oil reservoir. A system consistent with the invention may also, or alternatively, be configured for indirectly heating oil within a structure. For example, the system may be configured for heating injected miscible gases or liquids which are then used to heat the oil to promote EOR.

Figure 5:
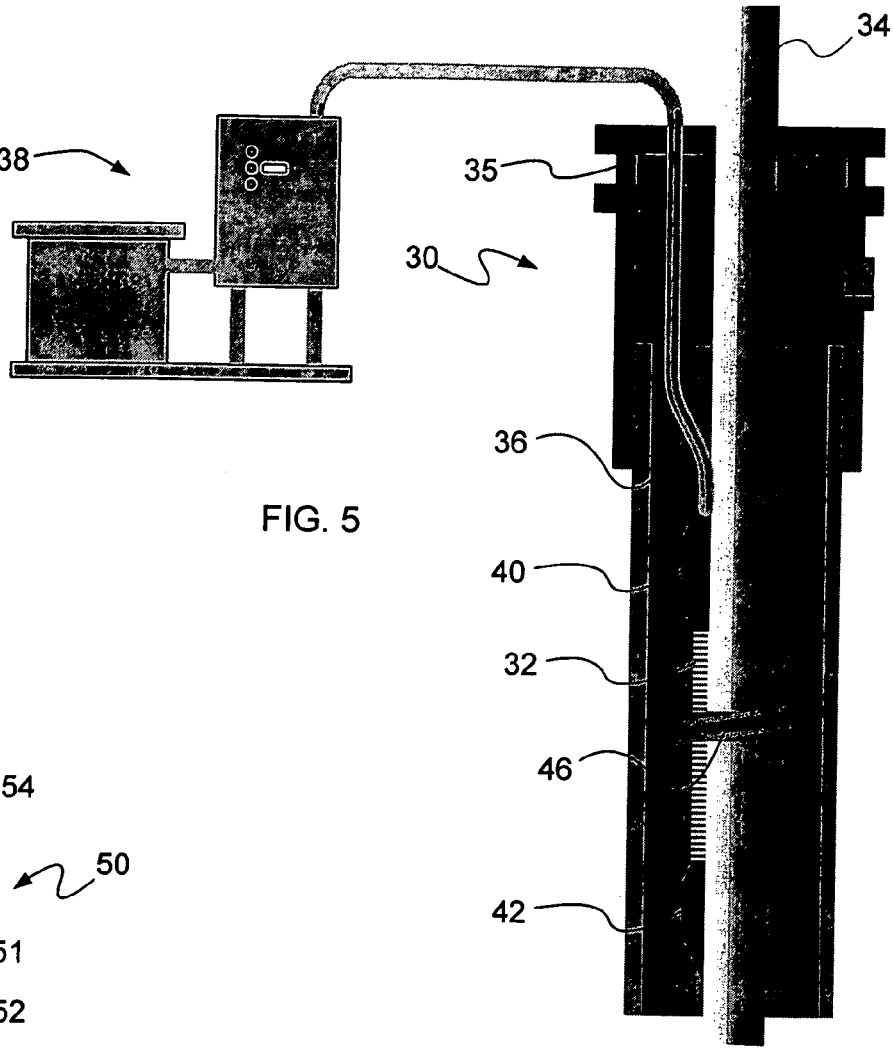
FIG. 5 is a schematic diagram of one embodiment of a subterranean electro-thermal heating system consistent with the present invention used for downhole heating.
Figure 7:
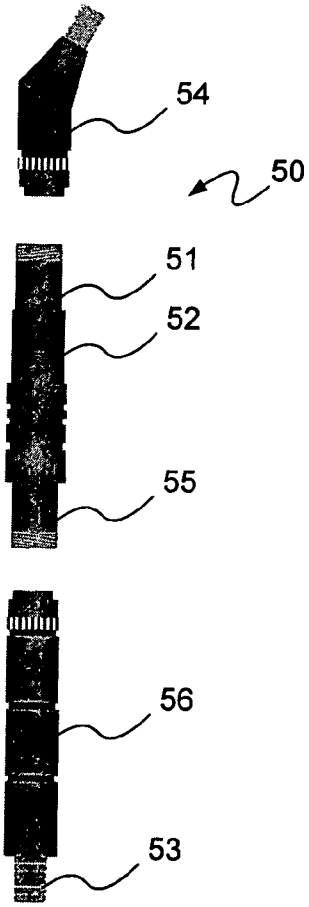
FIG. 7 is a schematic diagram of one embodiment of a pressurized-well feed-through assembly for connecting a cold lead to a heater cable in a downhole heating subterranean electro-thermal heating system used in a pressurized wellhead.
Figure 6:
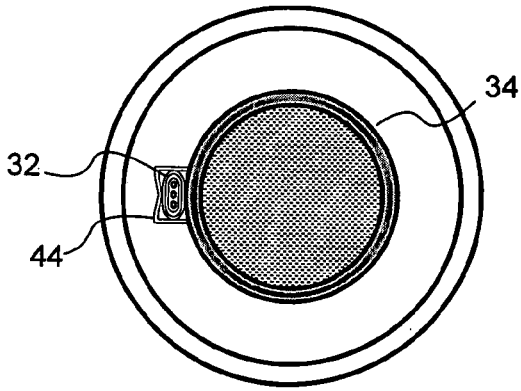
FIG. 6 is a schematic cross-sectional view of a heater cable secured to a production tube in the exemplary downhole heating subterranean electro-thermal heating system shown in FIG. 5.

One embodiment of a downhole subterranean electro-thermal heating system 30 consistent with the present invention is shown in FIGS. 5-7. The exemplary downhole subterranean electro-thermal heating system 30 includes a heater cable section 32 secured to a production tube 34 and a cold lead section 36 connecting the heater cable section 32 to power source equipment 38, such as a power panel and transformer. A power connector 40 electrically connects the cold lead section 36 to the heater cable section 32 and an end termination 42 terminates the heater cable section 32.

The cold lead section 36 extends through a wellhead 35 and down a section of the production tube 34 to a location along the production tube 34 where heating is desired. The length of the cold lead section 36 extending down the production tube 34 can depend upon where the heating is desired along the production tube 34 to facilitate oil flow, and can be determined by one skilled in the art. The length of the cold lead section 36 extending down the production tube 34 can also depend upon the depth of any non-target region (e.g., a permafrost region) through which the cold lead section 36 extends. In one example, the cold lead section 36 extends about 700 meters and the heater cable section 32 extends down the oil well in a range from about 700 to 1500 meters. Although one heater cable section 32 and one cold lead section 36 are shown in this exemplary embodiment, other combinations of multiple heater cable sections 32 and cold lead sections 36 are contemplated, for example, to form a segmented configuration along the production tube 34.

One example of the heating cable section 32 is a fluoropolymer jacketed armored 3-phase constant wattage cable with three jacketed conductors, and one example of the cold lead section 36 is a 3-wire 10 sq. mm armored cable. The power connector 40 may include a milled steel housing with fluoropolymer insulators to provide mechanical protection as well as an electrical connection. The power connector 40 may also be mechanically and thermally protected by sealing it in a hollow cylindrical steel assembly using a series of grommets and potting with a silicone-based compound. The end termination 42 may include fused fluoropolymer insulators to provide mechanical protection as well as an electrical Y termination of the conductors in the heater cable section 32.

As shown in FIG. 6, the heater cable section 32 may be secured to the production tube 34 using a channel 44, such as a rigid steel channel, and fastening bands 46 spaced along the channel 44 (e.g., every four feet). The channel 44 protects the heater cable section 32 from abrasion and from being crushed and ensures consistent heat transfer from the heating cable section 32 to the fluid in the production tube 34. One example of the channel 44 is a 16 gauge steel channel and one example of the fastening bands 46 are 20 gauge ½ inch wide stainless steel.

In use, the heater cable section 32 may be unspooled and fastened onto the production tube 34 as the tube 34 is lowered into a well. Before lowering the last section of the production tube 34 into the well, the heater cable section 32 may be cut and spliced onto the cold lead section 36. The cold lead section 36 may be fed through the wellhead and connected to the power source equipment 38. For non-pressurized wellheads, the cold lead section 36 may be spliced directly to the heater cable section 32 using the power connector 40.

For pressurized wellheads, a power feed-through mandrel assembly 50, shown for example in FIG. 7, may be used to penetrate the wellhead. The illustrated exemplary power feed-through mandrel assembly 50 includes a mandrel 52 that passes through the pressurized wellhead. A surface plug connector 54 is electrically coupled to the power source and connects to an upper connector 51 of the mandrel 52. A lower plug connector 56 is coupled to one of the system cables 53 (i.e. either a heater cable section or a cold lead section) and connects to a lower connector 55 of the mandrel 52.

Figure 8:
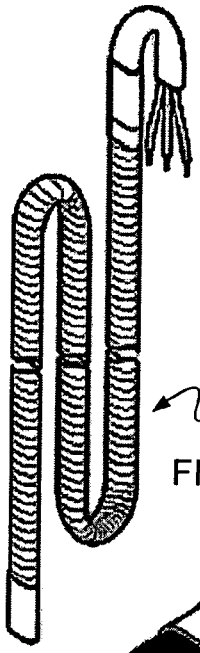
FIG. 8 is a schematic perspective view of one embodiment of an externally installed downhole heater cable consistent with the present invention.
Figure 9:
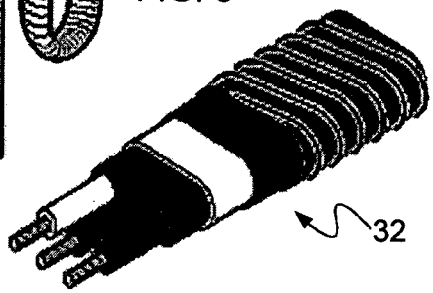
FIG. 9 is a schematic cross-sectional view of the heater cable shown in FIG. 8.

Again, those of ordinary skill in the art will recognize a variety of cable constructions that may be used as a heater cable in a system consistent with the present invention. One exemplary embodiment of an externally installed downhole heater cable section 32 for use in non-pressurized wells is shown in FIGS. 8-9. This exemplary heater cable section 32 provides three-phase power producing 11 to 14 watts/ft. and may be installed on the exterior of the production tube within a channel, as described above.

Figure 10:
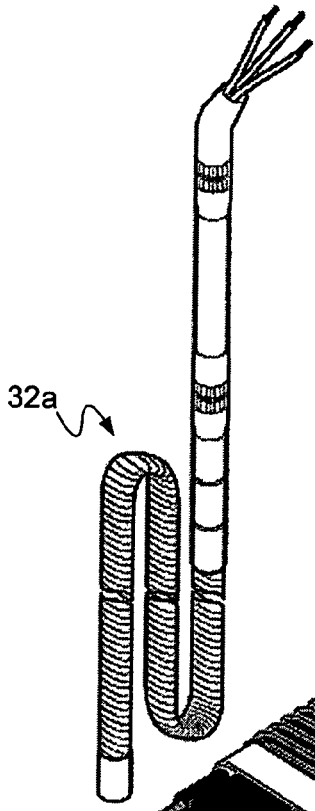
FIG. 10 is a schematic perspective view of another embodiment of an externally installed downhole heater cable consistent with the present invention.
Figure 11:
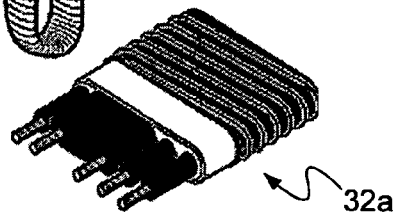
FIG. 11 is a schematic cross-sectional view of the heater cable shown in FIG. 10.

FIGS. 10-11 illustrate another embodiment 32*a* of an externally installed downhole heater cable section for use in pressurized wells in a manner consistent with the present invention. The exemplary cable section 32*a* provides three-phase power producing 14 to 18 watts/ft. and may be installed on the exterior of the production tube within a channel and using the feed-through mandrel, as described above.

Figure 12:
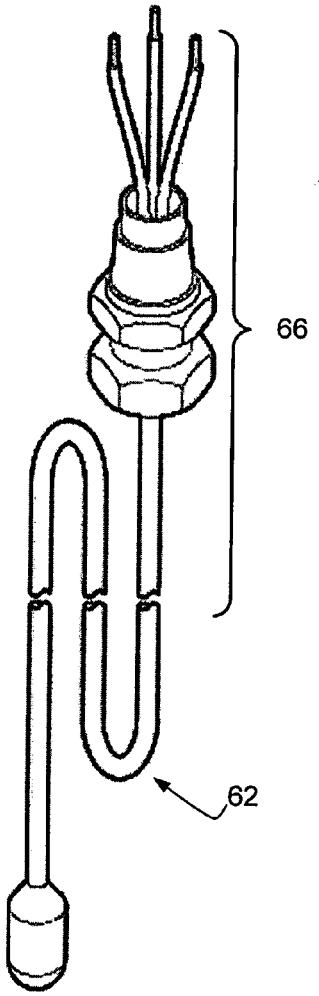
FIG. 12 is a schematic perspective view of one embodiment of an internally installed downhole heater cable consistent with the present invention.
Figure 13:
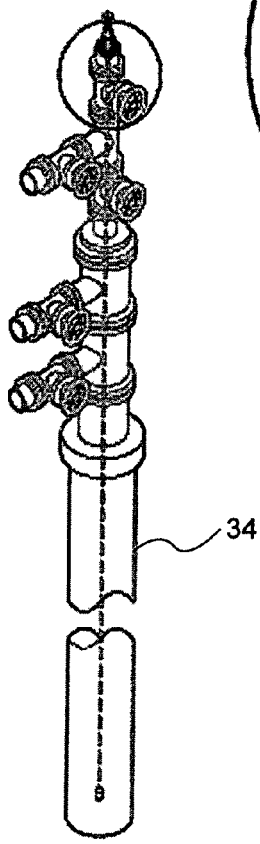
FIGS. 13-14 are schematic perspective views of the internally installed downhole heater cable shown in FIG. 12 installed in a production tube.
Figure 14:
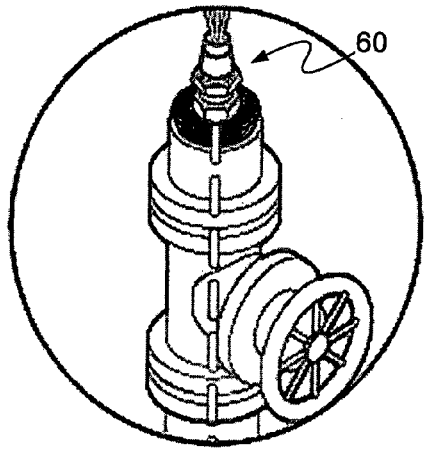

Another embodiment of a downhole subterranean electro-thermal heating system 60 includes an internally installed downhole heater cable section 62 and cold lead section 66 for use in pressurized or non-pressurized wells, as shown in FIGS. 12-14. The exemplary internally installed heater cable section 62 provides three phase power and produces 8 to 10 watts/ft. The internally installed heater cable section 62 may have a small diameter (e.g., of about ¼ in.) and may be provided as a continuous cable without a splice in a length of about 700 meters. The internally installed heater cable section 62 may also have a corrosion resistant sheath constructed, for example, of Incoloy 825. The internally installed heater cable section 62 can be relatively easily installed without pulling the production tubing.

Figure 15:
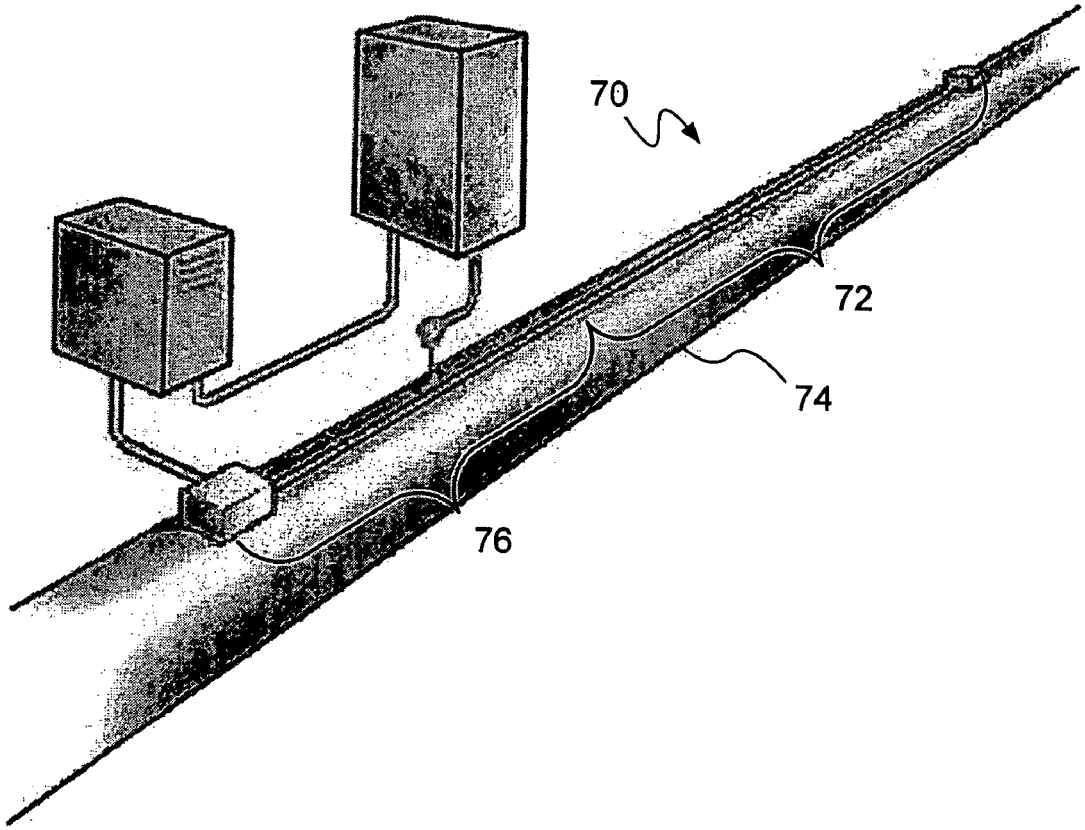
FIG. 15 is a schematic diagram of another embodiment of a subterranean electro-thermal heating system consistent with the present invention.

Another embodiment of a subterranean electro-thermal heating system 70 is shown in FIG. 15. In this embodiment, a STS heater cable section 72 having a cold lead section 76 coupled thereto is secured to a reservoir or pipe 74 running generally horizontally in the subterranean environment. Although one STS heater cable section 72 and one cold lead section 76 are shown, other combinations of multiple STS heater cable sections 72 and cold lead sections 76 are contemplated, for example, to form a segmented configuration along the reservoir or pipe 74.

In one embodiment, the components of the subterranean electro-thermal heating system (e.g., heater cable, cold lead, power connectors, and end terminations) may be provided separately to be assembled in the field according to the desired pattern of heated and non-target regions in the subterranean environment. For example, one or more sections of heater cable may be cut to length according to the number and dimensions of the desired heat target regions and one or more sections of cold leads may be cut to length according to the number and dimensions of the non-target regions. The heater cables and cold leads may then be interconnected and positioned in the subterranean environment accordingly.

Accordingly, a subterranean electro-thermal heating system consistent with the invention including one or more cold lead sections allows for strategic placement of heat input without unnecessary heating in certain subterranean regions. The use of the cold lead section(s) can reduce operating power usage and can minimize environmental issues such as heating through permafrost. The subterranean electro-thermal heating system further allows for segmented heat input.

While the principles of the invention have been described herein, it is to be understood that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A subterranean electro-thermal heating system comprising:

at least one heater cable section configured to generate a heater cable thermal output and to extend into at least one heat target region of a subterranean environment, said heater cable section being disposed adjacent and outside of an oil production tube at least partially disposed within said heat target region for heating oil in said oil production tube; and at least one cold lead section electrically coupled to said heater cable section and configured to extend through at least one non-target region of said subterranean environment for delivering electrical energy to said heater cable section, said cold lead section generating a cold lead thermal output less than said heater cable thermal output.

2. The system of claim 1 wherein said at least one said cold lead section has a length greater than or equal to 700 meters.

3. The system of claim 1 wherein said at least one cold lead section is configured to consume less than or equal to 10% of the power consumed by said at least one heater cable section.

4. The system of claim 1 wherein said at least one cold lead section is configured such that a voltage drop across said cold lead section is less than or equal to 15% of a total voltage drop across said at least one cold lead section and said at least one heater cable section.

5. The system of claim 1, said system comprising a plurality of said heater cable sections and said cold lead sections alternately interconnected to form a segmented electro-thermal heating system.

6. The system of claim 1, said system further comprising an electrical power source electrically coupled to an end of at least one of said cold lead sections.

7. The system of claim 1, said system further comprising a power connector connecting said heater cable section to said cold lead section.

8. The system of claim 1, said system further comprising at least one end termination coupled to an end of at least one of said heater cable sections.

9. The system of claim 1 wherein said heater cable section comprises a mineral insulated cable section.

10. The system of claim 1 wherein said heater cable section comprises a heater cable conductor providing a first resistance, and wherein said cold lead section comprises a cold lead cable conductor electrically coupled to said heater cable conductor, said cold lead cable conductor providing a second resistance lower than said first resistance.

11. The system of claim 1 wherein said heater cable section comprises a skin-effect tracing system.

12. The system of claim 1 wherein said cold lead section and said heater cable section extend through a wellhead.

13. The system of claim 1 further comprising:

a surface plug connector;

a feed-through mandrel extending through a pressurized well head and having a first end coupled to said surface plug connector; and a lower plug connector having a first end coupled to a second end of said feed through mandrel and having a second end coupled to a first one of said cold lead cable sections.

14. The system of claim 1 wherein said heater cable section is at least partially disposed in a liquid for heating said liquid and thereby indirectly heating said oil.

15. A subterranean electro-thermal heating system comprising:

at least one heater cable section configured to generate a heater cable thermal output and to extend into at least one heat target region of a subterranean environment;

at least one cold lead section electrically coupled to said heater cable section and configured to extend through at least one non-target region of said subterranean environment for delivering electrical energy to said heater cable section, said cold lead section generating a cold lead thermal output less than said heater cable thermal output;

a surface plug connector;

a feed-through mandrel extending through a pressurized well head and having a first end coupled to said surface plug connector; and a lower plug connector having a first end coupled to a second end of said feed through mandrel and having a second end coupled to a first one of said cold lead cable sections.

16. The system of claim 15 wherein said heater cable section is disposed adjacent a fluid-containing structure at least partially disposed within said heat target region of said subterranean environment for heating a fluid in said structure.

17. The system of claim 16 wherein said fluid-containing structure comprises a reservoir in said subterranean environment.

18. The system of claim 16 wherein said fluid comprises oil.

19. The system of claim 16 wherein said fluid-containing structure comprises an oil production tube and said fluid comprises oil.

20. The system of claim 19 wherein said heater cable section is disposed inside of said oil production tube.

21. The system of claim 19 wherein said heater cable section is located outside of said oil production tube.

22. The system of claim 16 wherein said heater cable section is at least partially disposed in a liquid for heating said liquid and thereby indirectly heating said fluid.

23. A subterranean electro-thermal heating system comprising:

at least one heater cable section disposed adjacent and outside of an oil production tube in a subterranean environment for imparting a heater cable thermal output to oil in said oil production tube; and at least one cold lead section electrically coupled to said heater cable section and extending through at least one non-target region of said subterranean environment for delivering electrical energy to said heater cable section, said cold lead section generating a cold lead thermal output less said heater cable thermal output and being configured to consume less than or equal to 10% of the power consumed by said at least one heater cable section.

24. The system of claim 23 wherein said at least one said cold lead section has a length of greater than or equal to 700 meters.

25. The system of claim 23 wherein said at least one cold lead section is configured such that a voltage drop across said cold lead section is less than or equal to 15% of a total voltage drop across said at least one cold lead section and said at least one heater cable section.

26. The system of claim 23, said system comprising a plurality of said heater cable sections and said cold lead sections alternately interconnected to form a segmented electro-thermal heating system.

27. The system of claim 23, said system further comprising an electrical power source electrically coupled to an end of at least one of said cold lead sections.

28. The system of claim 23, said system further comprising a power connector connecting said heater cable section to said cold lead section.

29. The system of claim 23, said system further comprising at least one end termination coupled to an end of at least one of said heater cable sections.

30. The system of claim 23 wherein said heater cable section comprises a mineral insulated cable section.

31. The system of claim 23 wherein said heater cable section comprises a heater cable conductor providing a first resistance, and wherein said cold lead section comprises a cold lead cable conductor electrically coupled to said heater cable conductor, said cold lead cable conductor providing a second resistance lower than said first resistance.

32. The system of claim 23 wherein said heater cable section comprises a skin-effect tracing system.

33. The system of claim 23 wherein said cold lead section and said heater cable section extend through a wellhead.

34. The system of claim 23 further comprising:

a surface plug connector;

a feed-through mandrel extending through a pressurized well head and having a first end coupled to said surface plug connector; and a lower plug connector having a first end coupled to a second end of said feed through mandrel and having a second end coupled to a first one of said cold lead cable sections.

35. The system of claim 23 wherein said heater cable section is at least partially disposed in a liquid for heating said liquid and thereby indirectly heating said oil.

36. A subterranean electro-thermal heating system comprising:

at least one heater cable section disposed adjacent a fluid-containing structure in a subterranean environment for imparting a heater cable thermal output to a fluid in said fluid-containing structure;

at least one cold lead section electrically coupled to said heater cable section and extending through at least one non-target region of said subterranean environment for delivering electrical energy to said heater cable section, said cold lead section generating a cold lead thermal output less said heater cable thermal output and being configured to consume less than or equal to 10% of the power consumed by said at least one heater cable section;

a surface plug connector;

a feed-through mandrel extending through a pressurized well head and having a first end coupled to said surface plug connector; and a lower plug connector having a first end coupled to a second end of said feed through mandrel and having a second end coupled to a first one of said cold lead cable sections.

37. The system of claim 36 wherein said fluid-containing structure comprises a reservoir in said subterranean environment.

38. The system of claim 36 wherein said fluid comprises oil.

39. The system of claim 36 wherein said fluid-containing structure comprises an oil production tube and said fluid comprises oil.

40. The system of claim 39 wherein said heater cable section is at least partially disposed inside of said oil production tube.

41. The system of claim 39 wherein said heater cable section is located outside of said oil production tube.

42. The system of claim 36 wherein said heater cable section is at least partially disposed in a liquid for heating said liquid and thereby indirectly heating said fluid.

43. A method of configuring a subterranean heating system for delivering thermal input to localized areas in a subterranean environment, said method comprising:

defining a pattern of at least one heat target region and at least one non-target region within said subterranean environment;

interconnecting at least one cold lead cable section with at least one heater cable section; and positioning said cold lead section and said heated cable section in said subterranean environment such that said heater cable section extends into an associated one of said heat target regions and adjacent and outside of an oil production tube at least partially disposed with said heat target region for providing a heater cable thermal output to said associated heat target region for heating oil in said oil production tube and such that said cold lead section passes through an associated one of said non-target regions for providing an associated cold lead thermal output less than said heater cable thermal output.

44. The method of claim 43 wherein said at least one cold lead section has a length greater than or equal to 700 meters.

45. The method of claim 43 wherein said at least one cold lead section is configured to consume less than or equal to 10% of the power consumed by said at least one heater cable section.

46. The method of claim 43 wherein said at least one cold lead section is configured such that a voltage drop across said cold lead section is less than or equal to 15% of a total voltage drop across said at least one cold lead section and said at least one heater cable section.

47. The method of claim 43 wherein said interconnecting at least one cold lead cable section with at least one heater cable section comprises alternately interconnecting a plurality of said cold lead cable sections with a plurality of said heater cable sections to form a segmented electro-thermal heating system.

* * * * *